US005651791A

United States Patent [19]

Zavlodaver et al.

[11] Patent Number: 5,651,791

[45] Date of Patent: Jul. 29, 1997

[54] MANUAL PIERCING DEVICE FOR PIERCING A HOLE IN A BODY PART

[76] Inventors: Mordechai Zavlodaver, 5801 Middle Crest Dr., Agoura Hills, Calif. 91301; Eliezer Sharf, 434/6 Morgentau Street, Ramot Jerusalem, Israel

[21] Appl. No.: 671,741

[22] Filed: Jun. 28, 1996

Related U.S. Application Data

[63] Continuation-in-part of Ser. No. 422,252, Apr. 14, 1995, abandoned.

[51] Int. Cl.[6] ..... A61B 17/34

[52] U.S. Cl. ..... 606/188; 606/117

[58] Field of Search ..... 606/188, 117, 606/116, 216, 120, 220, 141, 142, 143

[56] References Cited

U.S. PATENT DOCUMENTS

| | | | |
|---|---|---|---|
| 982,896 | 1/1911 | Stoll . | |
| 2,798,491 | 7/1957 | Samuels . | |
| 5,141,514 | 8/1992 | van Anelsfort | 606/117 |
| 5,462,554 | 10/1995 | Gardner | 606/117 |

FOREIGN PATENT DOCUMENTS 228513 5/1960 Australia .

*Primary Examiner*—Michael Powell Buiz
*Assistant Examiner*—Kevin Truong
*Attorney, Agent, or Firm*—Thomas I. Rozsa; Tony D. Chen

[57] ABSTRACT

A manual piercing device which can pierce a hole on a person's earlobe or other body parts. The piercing device utilizes the earring post of the earring to pierce the person's earlobe. It comprises an interchangeable disposable rubber sleeve and a rubber cup member for maintaining the piercing device sanitary. The piercing device will not contact any part of the person's body part when piercing the hole and will not spread any diseases.

22 Claims, 3 Drawing Sheets

MANUAL PIERCING DEVICE FOR PIERCING A HOLE IN A BODY PART

BACKGROUND OF THE INVENTION

This application is a Continuation-In-Part of patent application Ser. No. 08/422,252 filed on Apr. 14, 1995, now abandoned.

1. Field of The Invention

The present invention relates to the field of piercing devices. More particularly, the present invention relates to the field of manual piercing devices for piercing a hole on a body part of a person for the attachment of earrings or other ornaments.

2. Description of The Prior Art

Generally, ear piercing devices are known in the prior art and have been in existence for many years. These prior art devices include air cartridge guns for piercing a hole on the person's earlobe. One of the disadvantages with the prior art air cartridge guns is that they are very painful on the person's earlobe. Another disadvantage is that they are not highly accurate because of the constant moving of the person's head, for example a small infant. Still another disadvantage is that they have a very limited reach, are hard to control, and are not sanitary. In addition, the prior art ear piercing devices are not durable and can break easily.

It is desirable to have a very efficient and also very effective design and construction of an improved manual piercing device. It is also desirable to have an improved manual piercing device which is germ-free, so that it will not spread any diseases.

The following three (3) prior art patents were uncovered in the pertinent field of the present invention:

1. U.S. Pat. No. 982,896 issued to Stoll on Jan. 31, 1911 for "Earmark" (hereafter "the Stoll Patent");

2. U.S. Pat. No. 2,798,491 issued to Samuels on Jul. 9, 1957 for "Implement For Piercing Ear Lobes" (hereafter "the Samuels Patent"); and 3. Australia Patent No. 228,513 issued to Goldberg (hereafter "the Goldberg Patent").

The Stroll Patent discloses an earmark which is used in attaching the marks to the ear of an animal.

The Samuels Patent discloses an implement for piercing ear lobes. It comprises an upper jaw part which carries a vise for holding an ear ornament and an opposite jaw part which carries a block of cork. The opposite jaw part is formed with a pair of tines upon which the block is impaled to facilitate its ready removal and replacement. The block has a small slit to permit the easy entrance of the spindle. The vise is a split plate slidably disposed between the sidewall elements of the jaw. The split of the vise which extends beyond the end of the jaw has a resilient tendency to spread or separate to admit the spindle. An opening near the inner end of the split portion of the vise aids in producing the desired resiliency. In operation, the pointed spindle of the ear ornament with which the lobe is to be pierced is place between the jaws of the vise and the nut is turned in a direction to engage the end of the tube, therefore drawing the rod rearwardly and causing the vise to clamp the spindle securely. Turning the nut in the opposite direction, it will engage the block to advance the rod forwardly for opening or releasing the vise.

The Goldberg Patent discloses an improved device for punching holes in the ears of domestic animals to enable an ear tag to be attached thereto. It comprises a plier type device in which one of the jaws has a punch member and the opposing jaw is provided with a coacting anvil member.

Therefore, it is desirable to have a very efficient and also very effective design and construction of a manual piercing device for piercing a hole on a body part of a person for the attachment of earrings or other ornaments. It is also desirable to have an improved manual piercing device which is germ free, so that it will not spread any diseases.

SUMMARY OF THE INVENTION

The present invention is an improved manual piercing device for earrings. The objective of the present invention is to provide a manual piercing device which can pierce a hole on the person's body part such as earlobes, nipples and noses for attachment of earrings or other ornaments. The advantage of using the manual piercing device is that it is less painful than the prior art air cartridge gun. One of the unique features of the manual piercing device is that the earring post of the pierced earring itself does the piercing. It does not require any additional sharp pin for piercing the hole on the individual. Another feature of the present invention is that it has an interchangeable disposable protective sleeve and cup covers for maintaining the manual piercing device sanitary, such that the piercing device does not contact any part of the person's body part when piercing the hole and will not spread any diseases.

It is therefore an object of the present invention to provide an improved manual piercing device which can be easily operated to achieve high accuracy with improved control for piercing a hole on a body part of a person.

It is also an object of the present invention to provide an improved manual piecing device which can reach areas that the prior art air cartridge piercing gun cannot reach.

It is an additional object of the present invention to provide an improved manual piercing device which is capable of utilizing the earring post of the pierced earring for piercing a hole on a body part of a human being.

It is a further object of the present invention to provide an improved manual piercing device which has stopping flanges so that the holding/releasing lever mechanism will not be over tightened and break.

It is an additional object of the present invention to provide an improved manual piercing device which has an elongated arcuate receiving plate for placing the person's earlobe and extends upwardly to the earring post of the pierced earring, so that the distance in piercing a hole on the person's earlobe is shorter and less painful than the prior art cartridge piercing gun.

It is a further object of the present invention to provide an improved manual piercing device which has interchangeable disposable protective sleeves and rubber cup covers, so that the piercing device will not contact any part of the person's body part when piercing the hole and will not spread diseases.

Described briefly, the present invention is an improved manual piercing device which is generally shaped as a conventional pliers. It includes a front jaw portion and a rear handle portion. The jaw portion includes a clamping assembly for clamping the earring post of the pierced earring and a receiving assembly for receiving the person's earlobe.

The present invention is an improved manual piercing device for piercing a hole on a body part of a person for the attachment of earrings or other ornaments. The manual piercing device comprises a pair of cross-hinged shafts which forms a body of the device, an upper clamping assembly and a lower receiving assembly. In this embodiment, the upper clamping assembly has been changed, where the upper clamping assembly comprises a holding plate member and a holding/releasing lever member. The holding plate member has a pair of gripping arms which are formed on opposite sides of a longitudinal narrow slit. Each gripping arm has a protruding outer side boss which is integrally formed with a stopping flange located at a mid-section of the gripping arm. The lever member has two opposite engaging sidewalls which extend upwardly and each has a hook end. The lever member is mounted on top of the upper jaw member such that the upper jaw member is between the engaging sidewalls. As the lever member is moved forward to clamp the earring post between the gripping arms, the hook ends will engage the protruding outer side bosses which in turn squeezes the gripping arms together to hold the earring post thereto. The hook ends will also engage two stopping flanges which will prevent the over tightening of the clamping assembly but still allow the lever member to clamp the gripping arms together.

In an alternative embodiment, the present invention is an improved manual piercing device for piercing a hole on a body part of a person for the attachment of earrings or other ornaments. In this embodiment, the clamping assembly is the same as in the preferred embodiment except that the holding/releasing lever member has been changed, where the lever member has two slightly opposite inwardly engaging sidewalls which extend upwardly and each has a hook end. The lever member is mounted on top of the upper jaw member such that the upper jaw member is between the engaging sidewalls. As the lever member is moved forward to clamp the earring post between the gripping arms, the slightly inwardly engaging sidewalls will engage the gripping arms which in turn squeezes the gripping arms together to hold the earring post thereto. The hook ends will engage two stopping flanges which will prevent the over tightening of the clamping assembly but still allow the lever member to clamp the gripping arms together.

It is therefore an object of the present invention to provide a manual piercing device, where the piercing device has an improved clamping assembly which has two gripping arms with protruding outer side bosses, so that when the lever member is moved forward to a locked position, the hook ends of the lever member engage the protruding outer side bosses of the gripping arms which in turn squeeze the gripping arms together to hold the earring post thereto.

It is another object of the present invention to provide a manual piercing device, where the piercing device has an improved lever member with slightly inwardly opposite engaging sidewalls and hook ends, so that when the lever member is moved forward to a locked position, the hook ends of the engaging sidewalls engage the gripping arms which in turn squeeze the gripping arms together to hold the earring post thereto.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is an improved manual piercing device which is generally shaped as a conventional pliers. It includes a front jaw portion and a rear handle portion. The jaw portion includes a clamping assembly for holding or releasing the earring post of the pierced earring and a receiving assembly for receiving a person's earlobe or other parts of the body.

Figure 1:
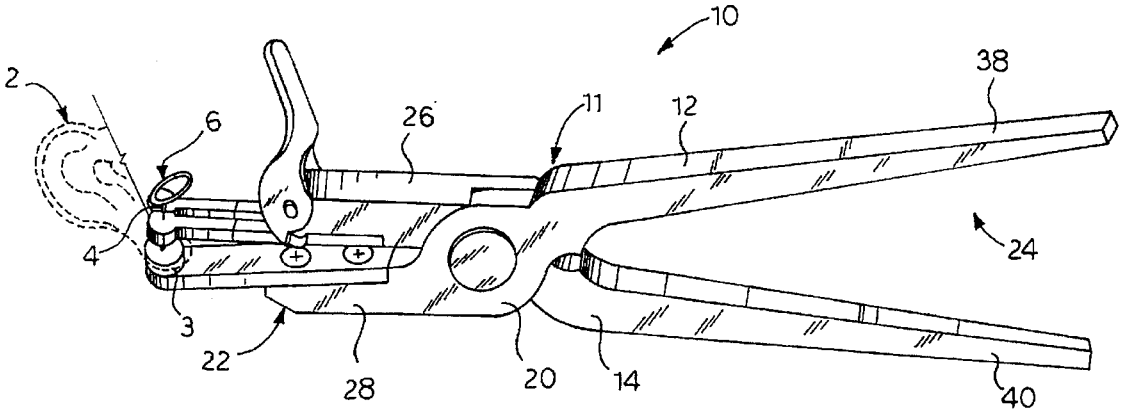
FIG. 1 is a perspective view of the preferred embodiment of the present invention manual piercing device, showing a person's earlobe being pierced by the earring post of the pierced earring.
Figure 2:
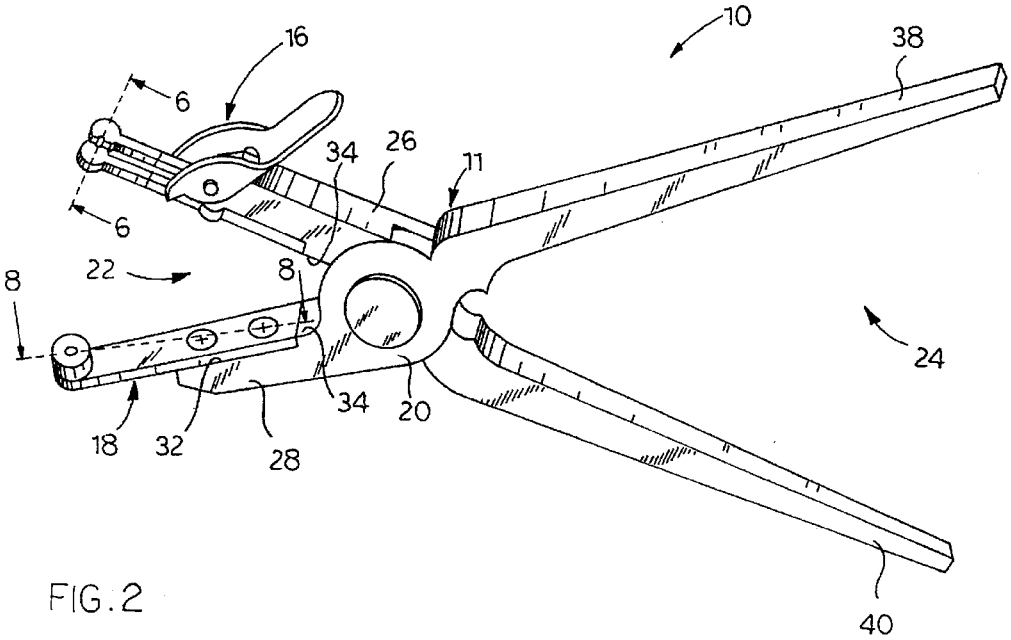
FIG. 2 is a perspective view of the preferred embodiment of the present invention manual piercing device.

FIG. 1 illustrates a perspective view of the present invention manual piercing device 10, showing a person's ear 2 with an earlobe 3 in dashed lines and being pierced by the earring post 4 of the pierced earring 6. Referring to FIGS. 1 and 2, the manual piercing device 10 includes a pair of elongated shafts or rods 12 and 14 which forms a body 11 of the ear piercing device 10, an upper clamping assembly 16 and a lower receiving assembly 18. The pair of elongated shafts 12 and 14 are hingeably cross-attached to each other at a location 20 which is approximately near the middle of the body 11 and form a front jaw portion 22, and a rear handle portion 24. The pair of elongated shafts 12 and 14 can be attached together by a slip joint or any other suitable means. By way of example, the body 11 of the piercing device 10 may be made of aluminum or any other suitable material.

Figure 3:
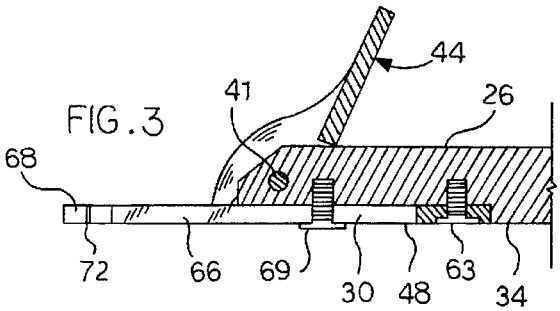
FIG. 3 is a partial cross-sectional view of the upper jaw member and the damping assembly.
Figure 8:
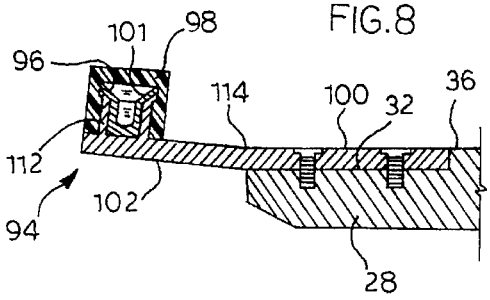
FIG. 8 is a cross-sectional view taken along line 8—8 of FIG. 2.

Referring to FIGS. 2, 3 and 8, the front jaw portion 22 has an upper jaw member or means 26 and a lower jaw member or means 28. The upper jaw member 26 has a bottom surface 34 which has an inner step-down section 30. The lower jaw member 28 has a top surface 36 which also an inner step-down section 32. The rear handle portion 24 has an upper handle member 38 and a lower handle member 40 for grasping the piercing device 10 thereto.

Referring to FIGS. 3, 4, 5 and 6, the upper clamping assembly 16 includes an elongated holding plate member 42 and a holding/releasing lever member 44. The holding plate member 42 has a top side 46, a bottom side 48, a proximal section 50 with a proximal end 52, a middle section 54, a distal section 56 with a distal end 58, and a longitudinal narrow slit 60 which extends from the middle section 54 to the distal end 58. The holding plate member 42 also has an opening 62 which is located on the proximal section 50 and adjacent to proximal end 52 for allowing a screw 63 to be inserted therethrough. The proximal section 50 is attached to the step-down section 30 of the upper jaw member 26 by inserting the screw 63 through the opening 62 and being threadedly engaged with the upper jaw member 26. Another screw 69 is inserted in the narrow slit 60 and is threadedly engaged with the upper jaw member 26, thereby securing the holding plate member 42 to the upper jaw member 26. The bottom side 48 of the holding plate member 42 is flush with the bottom surface 34 of the upper jaw member 26. The distal section 56 of the holding plate member 42 extends forwardly away from the jaw portion 22.

Figure 4:
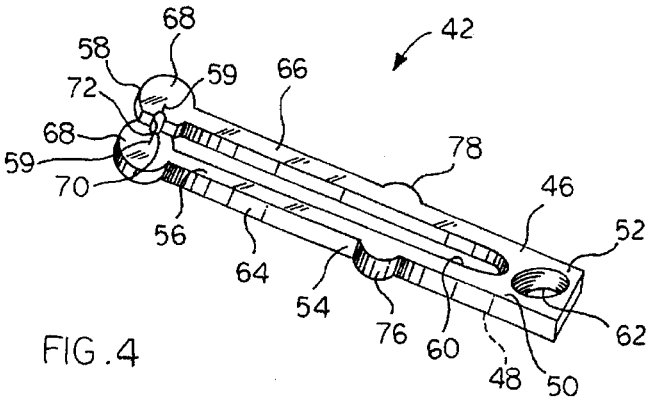
FIG. 4 is an enlarged perspective view of the holding plate means.

Referring to FIG. 4, there is shown a pair of gripping arms 64 and 66 of the holding plate member 42 which are formed on opposite sides of the longitudinal narrow slit 60 and are positioned in a substantially parallel and spaced apart relationship. Each gripping arm has a semi-circular tip 68 with an indicator alignment line 59. The semi-circular tips 68 are located at the distal end 58 of the holding plate member 42. A pair of narrow semi-circular grooves 70 and 72 are provided vertically on the semi-circular tips 68 respectively and face each other. These semi-circular grooves 70 and 72 are utilized for holding the earring post of the pierced earring such that the indicator alignment lines 59 will assist the user to align the earring post with the narrow semi-circular grooves 70 and 72.

Figure 6:
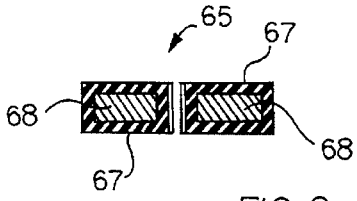
FIG. 6 is an enlarged cross-sectional view taken along line 6—6 of FIG. 2.

FIG. 6 shows a cross-sectioned view of the pair of gripping arms 64 and 66. Referring to FIGS. 4 and 6, there is shown a disposable protective sleeve 65 which is used similar to a condom. The disposable protective sleeve 65 is a unitary component and is integrally formed. The protective sleeve 65 comprises a pair of sleeve arms 67 which cover and protect the semi-circular tips 68 and the gripping arms 64 and 66 respectively and conform to the shape thereof. The pair of sleeve arms 67 partially cover the middle section 54 of the holding plate member 42, but still allow the lever member 44 to clamp the gripping arms 64 and 66 together. By way of example, the disposable protective sleeve 65 is made of latex material, rubber material or any other suitable material.

Figure 5:
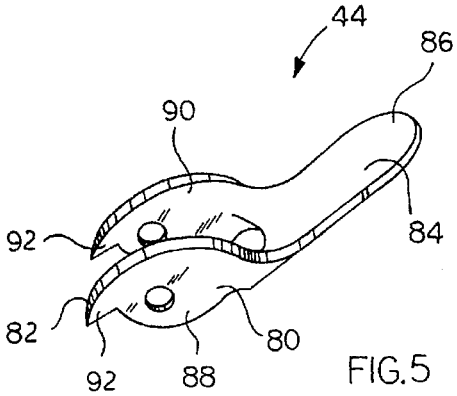
FIG. 5 is an enlarged perspective view of the holding/releasing lever means.

Referring to FIGS. 3 and 5, the lever member 44 has a proximal section 80 with an open proximal end 82 and a distal section 84 with a distal end 86 which forms a handle of the lever member 44. The proximal section 80 has two opposite engaging sidewalls 88 and 90 which are substantially identical and parallel in a spaced apart relationship. The two opposite engaging sidewalls 88 and 90 extend upwardly and each has a hook end 92 which is located on the proximal end 82. The open proximal end 82 is mounted on top of the upper jaw member 26 such that the upper jaw member 26 is between the engaging sidewalls 88 and 90 of the lever member 44. The engaging sidewalls 88 and 90 are hingeably attached to the upper jaw member 26 by a pin fastener 41. The hook ends 92 of the engaging sidewalls 88 and 90 are approximately located adjacent to the middle section 54 of the holding plate member 42. The hook ends 92 will engage two stopping flanges 76 and 78 which are provided and integrally attached at the middle section 54 of the holding plate member 42. The stopping flanges 76 and 78 will prevent the over tightening of the clamping assembly 16. This allows the distal section 84 of the lever member 44 to move in a forward direction to clamp the earring post between the semi-circular tips 68 of the gripping arms 64 and 66 without the fear of over tightening the lever member 44. The distal section 84 can also move in a backward direction to unclamp the earring post. By way of example, the clamping assembly 16 may be made of a treated metal material with a chrome finish, for example stainless steel material.

Figure 7:
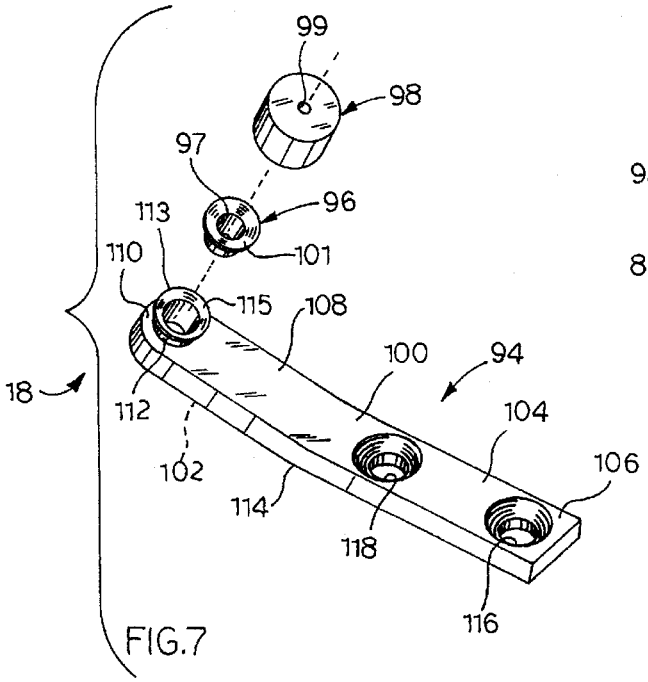
FIG. 7 is an enlarged exploded perspective view of the receiving plate means.

Referring to FIG. 7, there is shown an exploded view of the lower receiving assembly 18 which includes an elongated receiving plate member or means 94, an inner disposable cup cover member 96 or protection means which has a concave cavity 97, and an outer disposable cup cover member 98 or protection means which has a central opening 99. The receiving plate member 94 has a top side 100, a bottom side 102, a proximal section 104 with a proximal end 106, and a distal section 108 with a distal end 110. The receiving plate member 94 is generally an arcuate shape. It bends at approximately a middle point 114 such that the distal section 108 extends upwardly and forwardly. This generally arcuate shape of the receiving plate member 94 is unique because the distance to pierce a hole on the person's earlobe is reduced. The receiving plate member 94 is further provided with two countersunk openings 116 and 118 which are located on the proximal section 104 for allowing two screws to be inserted therethrough to threadedly secure the receiving plate member 94 to the lower jaw member 28, as shown in FIG. 2. The receiving plate member 94 also has a cup member or means 112 which is integrally attached on the top side 100 and located adjacent to the distal end 110. The cup member 112 has a concave cavity 113 with an upper lip 115.

Referring to FIG. 8, the proximal section 104 of the receiving plate member 94 is attached to the step-down section 32 of the lower jaw member 28 such that the top side 100 is flush with the top surface 36 of the step-down section 32. The distal end 110 of the receiving plate member 94 extends forwardly away from the jaw portion 22. By way of example, the receiving plate member 94 may be made of a treated metal material with a chrome finish, for example stainless steel material.

The inner disposable cup cover member 96 has an upper lip 101. The inner disposable cup cover member 96 is placed within the concave cavity 113 of-the cup member 112 of the receiving plate member 94 such that the upper lip 101 of the disposable cup cover member 96 engages with the upper lip 115 of the cup member 112. The inner disposable cup cover member 96 is used for protecting and covering the cup member 112. The disposable cup cover 96 provides a germ-free piercing device, so that it does not spread any diseases. The outer disposable cup cover member 98 protects and covers both the inner cup cover member 96 and the cup member 112 and provides a double protection for preventing the spread of diseases. By way of example, the inner disposable cup cover member 96 can be made of metal or plastic material or any other suitable material. By way of example, the outer disposable cup cover member 98 can be made of rubber material or any other suitable material.

The manufacturing process which could accommodate the construction of the manual piercing device 10 may be injection, thermoform, etc. or other molding process. The present invention conforms to conventional forms of manufacture, and is easy to use.

Referring again to FIGS. 1, 2 and 3, the operation of the foregoing embodiment will now be described. The earring post 4 is secured between the two narrow semi-circular grooves 70 and 72 of the gripping arms 64 and 66 respectively. The lever member 44 is moved forward to clamp the earring post 4 thereto, and the upper and lower handle members 38 and 40 are squeezed together so that the earring post 4 pierces a hole on the person's earlobe 3. Once the handle members 38 and 40 are squeezed together, the earring post 4 will be aligned with and inserted into the central opening 99 of the outer disposable cup cover member 98.

Figure 9:
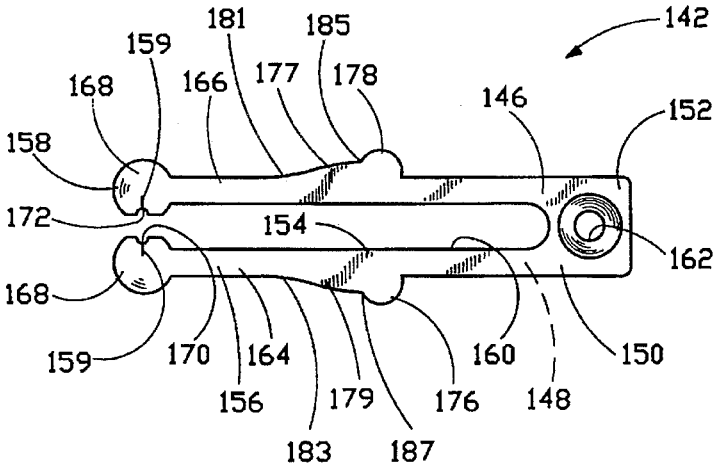
FIG. 9 is a plan view of an alternative embodiment of the holding plate means of the present invention manual piercing device.

Referring to FIG. 9, there is shown a plan view of an alternative embodiment of the holding plate member 142 of the present invention manual piercing device. In this embodiment, only the holding plate member 142 has been changed and therefore the description of the holding plate member 142 will only be described and the rest of the elements are the same as in the preceding embodiment.

Figure 10:
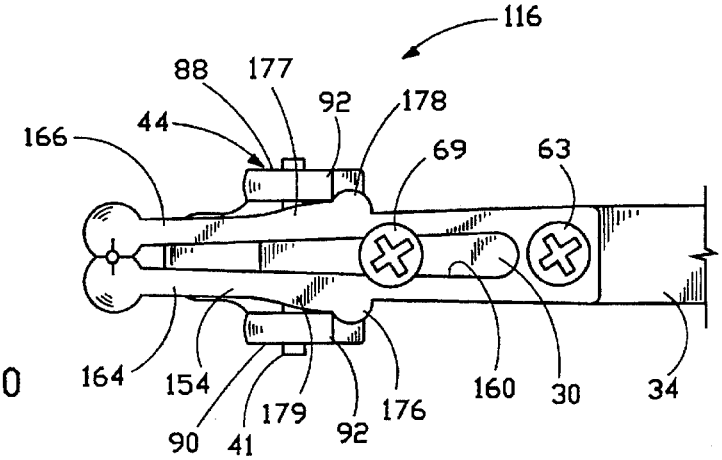
FIG. 10 is a plan view of the clamping assembly of the present invention manual piercing device, showing the holding/releasing lever means and the holding plate means which is shown in FIG. 9.

FIG. 10 shows a plan view of the clamping assembly 116 of the present invention manual piercing device. Referring to FIGS. 9 and 10, there is shown the holding plate member 142 of the present invention improved manual piercing device. The holding plate member 142 has a top side 146, a bottom side 148, a proximal section 150 with a proximal end 152, a middle section 154, a distal section 156 with a distal end 158, and a longitudinal narrow slit 160 which extends from the proximal section 150 to the distal end 158. The holding plate member 142 also has an opening 162 which is located on the proximal section 150 and adjacent to proximal end 152 for allowing a screw 63 to be inserted therethrough such that the head of the screw 63 is flush with top side 146. The proximal section 150 is attached to the step-down section 30 of the upper jaw member 26 by inserting the screw 63 through the opening 162 and being threadedly engaged with the upper jaw member 26. Another screw 69 is inserted in the narrow slit 160 and is threadedly engaged with the upper jaw member 26, thereby securing the holding plate member 142 to the upper jaw member 26. The bottom side 148 of the holding plate member 142 is flush with the bottom surface 34 of the upper jaw member 26. The distal section 156 of the holding plate member 142 extends forwardly away from the jaw portion 22.

The holding plate member 142 has a pair of gripping arms 164 and 166 which are formed on opposite sides of the longitudinal narrow slit 160. Each gripping arm has a semi-circular tip 168 with an indicator alignment line 159. The semi-circular tips 168 are located at the distal end 158 of the holding plate member 142. A pair of narrow semi-circular grooves 170 and 172 are provided vertically on the semi-circular tips 168 respectively and face each other. These semi-circular grooves 170 and 172 are utilized for holding the earring post of the pierced earring such that the indicator alignment lines 159 will assist the user to align the earring post with the narrow semi-circular grooves 170 and 172. The holding plate member 142 is provided with protruding outer side bosses 179 and 177 which are respectively integrally formed with the gripping arms 164 and 166 and stopping flanges 176 and 178 and located at the middle section 154. These protruding outer side bosses 177 and 179 are at an inclined angle, where the angle rises from the distal section 156 of the holding plate member 142 to the proximal section 150 of the holding plate member 142.

Referring to FIG. 10, there is shown the lever member 44 in the forward locked position to clamp the earring post between the semi-circular tips 168 of the gripping arms 164 and 166. The hook ends 92 of the engaging sidewalls 88 and 90 of the lever member 44 will move forward to engage the protruding outer side bosses 177 and 179 at locations 181 and 183. As the inclined angles of the protruding outer side bosses 177 and 179 rise at locations 181 and 183 to locations 185 and 187 respectively, the hook ends 92 of the engaging sidewalls 88 and 90 will engage the inclined angles, which in turn squeeze the gripping arms 164 and 166 together to hold the earring post thereto. The hook ends 92 will also engage the stopping flanges 176 and 178 as well, which will prevent the over tightening of the clamping assembly 116 but still allow the lever member 44 to clamp the gripping arms together. This allows the distal section 84 of the lever member 44 to move in a forward direction to clamp the earring post between the semi-circular tips 168 of the gripping arms 164 and 166 without the fear of over tightening the lever member 44. The distal section 84 can also move in a backward direction to unclamp the earring post.

Figure 11:
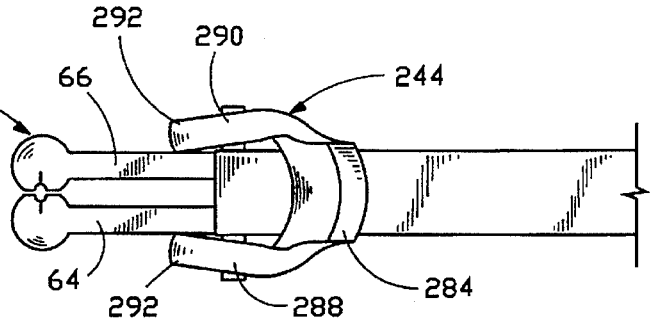
FIG. 11 is a plan view of another alternative embodiment of the present invention manual piercing device, showing the clamping assembly which includes a new holding/releasing lever means and the holding plate means.

Referring to FIG. 11, there is shown another alternative embodiment of the present invention lever member 244, where the lever member 244 is slightly moved forward to an almost locked position. In this embodiment, the two opposite engaging sidewalls 288 and 290, and the hook ends 292 are slightly curved inward so that the width between the engaging sidewalls is slightly wider than the width of the gripping arms 64 and 66 such that when the distal section 284 of the lever member 244 is moved forward to a locked position, the hook ends 292 of the engaging sidewalls 288 and 290 engage and squeeze the outer parts of the two gripping arms 64 and 66 of the hold plate member 42 together to hold the earring post thereto. The holding plate member 42 is the same as shown in FIG. 4.

Defined in detail, the present invention is a piercing device for piercing a hole on a person's earlobe and used in conjunction with an earring having an earring post, the piercing device comprising: (a) a body formed by a pair of elongated shafts hingeably cross-attached to each other at a location approximately near a middle of the body and forming a handle portion and a jaw portion, the handle portion having an upper handle member and a lower handle member for grasping the body, the jaw portion having an upper jaw member with a bottom surface and a lower jaw member with a top surface, wherein each jaw member has an inner step-down section, each inner step-down section facing the other; (b) a generally elongated arcuate shaped receiving plate member having a top side, a bottom side, a proximal section with a proximal end, and a distal section with a distal end; (c) the proximal section of the arcuate shaped receiving plate member attached to the step-down section of the lower jaw member such that the top side is flush with the top surface of the lower jaw member, where the distal end of the receiving plate member extends forwardly away from the jaw portion; (d) a cup member integrally formed on the top side of the receiving plate member and located adjacent to the distal end and having a concave cavity facing upwardly; (e) an inner disposable protection means placed within the concave cavity of the cup member for protecting and covering the cup member of the receiving plate member; (f) an outer disposable protection means for protecting and covering the inner disposable protection means and the cup member of the receiving plate member and having a central opening for allowing the earring post to be inserted therethrough; (g) an elongated holding plate member having a top side, a bottom side, a proximal section with a proximal end, a middle section, and a distal section with a distal end, the holding plate having a longitudinal narrow slit extending from its middle section to its distal end and forming a pair of gripping arms which are positioned in a substantially parallel and spaced apart relationship, each gripping arm having a semi-circular tip with a vertical narrow semi-circular groove, each narrow semi-circular groove facing the other for receiving the earring post; (h) the proximal section of the holding plate member attached to the step-down section of the upper jaw member such that the bottom side of the holding plate member is flush with the bottom surface of the upper jaw member, where the distal end of the holding plate member extends forwardly away from the jaw portion; (i) a pair of stopping flanges integrally attached to the middle section of the holding plate member and located opposite to each other; (j) a pair of protruding bosses integrally formed with the pair of gripping arms and the pair of stopping flanges, each protruding boss having an inclined angle which rises from the distal section of the holding plate member to the proximal section of the holding plate member; (k) a lever member having a proximal section with an open proximal end, a distal section with a distal end, and two parallel opposite engaging sidewalls which are positioned in a spaced apart relationship, each engaging sidewall having a hook end located on the open proximal end for engaging with the pair of protruding bosses respectively so that the gripping arms are forced to move towards each other in order to clamp the earring post of the earring, and the hook ends further engaging the pair of stopping flanges respectively so that the lever member is not over tightened; (l) the two parallel opposite engaging sidewalls of the lever member hingeably attached to the upper jaw member and located adjacent to the middle section of the holding plate member such that the gripping arms of the holding plate member are between the two parallel opposite engaging sidewalls respectively; and (m) a disposable protective sleeve for protecting and covering the pair of gripping arms; (n) whereby when the earring post is received between the two narrow semi-circular grooves of the semi-circular tips of the gripping arms, the distal section of the lever member can be moved forward to force the gripping arms to move towards each other in order to clamp the earring post of the earring, and the upper and lower handle members can be squeezed together to cause the earring post to pierce the hole on the person's earlobe.

Defined broadly, the present invention is a piercing device for piercing a hole on a body part of a person and used in conjunction with an earring post, the piercing device comprising: (a) a pair of shafts hingeably cross-attached to each other and forming a handle portion and a jaw portion, the handle portion having an upper handle member and a lower handle member, the jaw portion having an upper jaw member with a bottom surface and a lower jaw member with a top surface, wherein each jaw member has a step-down section, each step-down section facing the other; (b) an arcuate shaped receiving plate member having a top side, a bottom side, a proximal section and a distal section; (c) the proximal section of the arcuate shaped receiving plate member attached to the step-down section of the lower jaw member such that the top side is flush with the top surface of the lower jaw member, where the distal section of the receiving plate member extends forwardly away from the jaw portion; (d) a cup member integrally formed on the top side of the receiving plate member and located adjacent to the distal section and having a cavity facing upwardly; (e) means for protecting and covering the cup member of the receiving plate member; (f) a holding plate ember having a top side, a bottom side, a proximal section, a middle section, and a distal section, the holding plate member having a narrow slit extending from its middle section to its distal section and forming two gripping arms which are positioned in a substantially parallel and spaced apart relationship for receiving the earring post; (g) the proximal section of the holding plate member attached to the step-down section of the upper jaw member such that the bottom side of the holding plate member is flush with the bottom surface of the upper jaw member, where the distal section of the holding plate member extends forwardly away from the jaw portion; (h) at least one stopping flange attached to the middle section of the holding plate member; (i) at least two protruding bosses attached to the gripping arms and located at the middle section of the holding plate member, each protruding boss having an inclined angle which rises from the distal section of the holding plate member to the proximal section of the holding plate member; (j) a lever member having an open proximal section and a distal section, the open proximal section having two engaging sidewalls which are positioned in a spaced apart relationship, each sidewall having a hook end for engaging with the at least two protruding bosses so that the gripping arms are forced to move towards each other in order to clamp the earring post, and the hook ends further engaging the at least one stopping flange so that the lever member is not over tightened; (k) the two opposite engaging sidewalls of the lever member hingeably attached to the upper jaw member and located adjacent to the middle section of the holding plate member such that the two gripping arms of the holding plate member are between the two opposite engaging sidewalls respectively; and (l) means for protecting and covering the two gripping arms respectively; (m) whereby when the earring post is received between the two gripping arms, the distal section of the lever member can be moved to cause the earring post to be clamped, and the upper and lower handle members can be squeezed together to cause the earring post to pierce the hole on the body part of the person.

Defined more broadly, the present invention is a piercing device for piercing a hole on a body part of a person and used in conjunction with an earring post, the piercing device comprising: (a) a pair of shafts hingeably attached to each other and forming a handle portion and a jaw portion, the handle portion having an upper handle means and a lower handle means, the jaw portion having an upper jaw means and a lower jaw means; (b) a receiving plate means having a proximal section and a distal section, the proximal section attached to the lower jaw means such that the distal section extends forwardly away from the jaw portion; (c) a cup means attached to the receiving plate means; (d) a holding plate means having a distal section and a proximal section, the distal section having two gripping arms with a slit therebetween for receiving the earring post, the proximal section attached to the upper jaw means such that the two gripping arms extend forwardly away from the jaw portion; (e) a lever means hingeably attached to the upper jaw means for operating the gripping arms to clamp the earring post; and (f) means for forcing the gripping arms toward each other in order to clamp the earring post; (g) whereby when the earring post is received between the gripping arms, the lever means can be moved to cause the earring post to be clamped, and the upper and lower handle means can be squeezed together to cause the earring post to pierce the hole on the body part of the person.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A piercing device for piercing a hole on a person's earlobe and used in conjunction with an earring having an earring post, the piercing device comprising:

a. a body formed by a pair of elongated shafts hingeably cross-attached to each other at a location approximately near a middle of the body and forming a handle portion and a jaw portion, the handle portion having an upper handle member and a lower handle member for grasping the body, the jaw portion having an upper jaw member with a bottom surface and a lower jaw member with a top surface, wherein each jaw member has an inner step-down section, each inner step-down section facing the other;

b. a generally elongated arcuate shaped receiving plate member having a top side, a bottom side, a proximal section with a proximal end, and a distal section with a distal end;

c. said proximal section of said arcuate shaped receiving plate member attached to said step-down section of said lower jaw member such that said top side is flush with said top surface of said lower jaw member, where said distal end of said receiving plate member extends forwardly away from said jaw portion;

d. a cup member integrally formed on said top side of said receiving plate member and located adjacent to said distal end and having a concave cavity facing upwardly;

e. an inner disposable protection means placed within said concave cavity of said cup member for protecting and covering said cup member of said receiving plate member;

f. an outer disposable protection means for protecting and covering said inner disposable protection means and said cup member of said receiving plate member and having a central opening for allowing said earring post to be inserted therethrough;

g. an elongated holding plate member having a top side, a bottom side, a proximal section with a proximal end, a middle section, and a distal section with a distal end, the holding plate having a longitudinal narrow slit extending from its middle section to its distal end and forming a pair of gripping arms which are positioned in a substantially parallel and spaced apart relationship, each gripping arm having a semi-circular tip with a vertical narrow semi-circular groove, each narrow semi-circular groove facing the other for receiving said earring post;

h. said proximal section of said holding plate member attached to said step-down section of said upper jaw member such that said bottom side of said holding plate member is flush with said bottom surface of said upper jaw member, where said distal end of said holding plate member extends forwardly away from said jaw portion;

i. a pair of stopping flanges integrally attached to said middle section of said holding plate member and located opposite to each other;

j. a pair of protruding bosses integrally formed with said pair of gripping arms and said pair of stopping flanges, each protruding boss having an inclined angle which rises from said distal section of said holding plate member to said proximal section of said holding plate member;

k. a lever member having a proximal section with an open proximal end, a distal section with a distal end, and two parallel opposite engaging sidewalls which are positioned in a spaced apart relationship, each engaging sidewall having a hook end located on the open proximal end for engaging with a respective one of said pair of protruding bosses respectively so that said gripping arms are forced to move towards each other in order to clamp said earring post of said earring, and the hook ends further engaging said pair of stopping flanges respectively so that the lever member is not over tightened;

l. said two parallel opposite engaging sidewalls of said lever member hingeably attached to said upper jaw member and located adjacent to said middle section of said holding plate member such that said gripping arms of said holding plate member are between said two parallel opposite engaging sidewalls respectively; and m. a disposable protective sleeve for protecting and covering said pair of gripping arms;

n. whereby when said earring post is received between said two narrow semi-circular grooves of said semi-circular tips of said gripping arms, said distal section of said lever member can be moved forward to force said gripping arms to move towards each other in order to clamp said earring post of said earring, and said upper and lower handle members can be squeezed together to cause said earring post to pierce said hole on said person's earlobe.

2. The piercing device as defined in claim 1 wherein said disposable protective sleeve is made of latex material.

3. The piercing device as defined in claim 1 wherein each semi-circular tip of each gripping arm further comprises indicator alignment markings.

4. The piercing device as defined in claim 1 wherein said body is made of aluminum material.

5. A piercing device for piercing a hole on a body part of a person and used in conjunction with an earring post, the piercing device comprising:

a. a pair of shafts hingeably cross-attached to each other and forming a handle portion and a jaw portion, the handle portion having an upper handle member and a lower handle member, the jaw portion having an upper jaw member with a bottom surface and a lower jaw member with a top surface, wherein each jaw member has a step-down section, each step-down section facing the other;

b. an arcuate shaped receiving plate member having a top side, a bottom side, a proximal section and a distal section;

c. said proximal section of said arcuate shaped receiving plate member attached to said step-down section of said lower jaw member such that said top side is flush with said top surface of said lower jaw member, where said distal section of said receiving plate member extends forwardly away from said jaw portion;

d. a cup member integrally formed on said top side of said receiving plate member and located adjacent to said distal section and having a cavity facing upwardly;

e. means for protecting and covering said cup member of said receiving plate member;

f. a holding plate member having a top side, a bottom side, a proximal section, a middle section, and a distal section, the holding plate member having a narrow slit extending from its middle section to its distal section and forming two gripping arms which are positioned in a substantially parallel and spaced apart relationship for receiving said earring post;

g. said proximal section of said holding plate member attached to said step-down section of said upper jaw member such that said bottom side of said holding plate member is flush with said bottom surface of said upper jaw member, where said distal section of said holding plate member extends forwardly away from said jaw portion;

h. at least one stopping flange attached to said middle section of said holding plate member;

i. at least two protruding bosses with a respective one protruding boss attached to a respective one of said gripping arms and located at said middle section of said holding plate member, each protruding boss having an inclined angle which rises from said distal section of said holding plate member to said proximal section of said holding plate member;

j. a lever member having an open proximal section and a distal section, the open proximal section having two engaging sidewalls which are positioned in a spaced apart relationship, each sidewall having a hook end for engaging with a respective one of said at least two protruding bosses so that said gripping arms are forced to move towards each other in order to clamp said earring post, and the hook ends further engaging said at least one stopping flange so that the lever member is not over tightened;

k. said two opposite engaging sidewalls of said lever member hingeably attached to said upper jaw member and located adjacent to said middle section of said holding plate member such that said two gripping arms of said holding plate member are between said two opposite engaging sidewalls respectively; and l. means for protecting and covering said two gripping arms respectively;

m. whereby when said earring post is received between said two gripping arms, said distal section of said lever member can be moved to cause said earring post to be clamped, and said upper and lower handle members can be squeezed together to cause said earring post to pierce said hole on said body part of said person.

6. The piercing device as defined in claim 5 further comprising an inner disposable protection means placed between said cup member and said means for protecting and covering said cup member.

7. The piercing device as defined in claim 6 wherein said inner disposable protection means is made of metal material.

8. The piercing device as defined in claim 6 wherein said means for protecting and covering said cup member of said receiving plate member is an outer disposable protection means.

9. The piercing device as defined in claim 8 wherein said outer disposable protection means is made of rubber material.

10. The piercing device as defined in claim 5 wherein said means for protecting and covering said two gripping arms is a disposable protective sleeve.

11. The piercing device as defined in claim 10 wherein said disposable protective sleeve is made of latex material.

12. The piercing device as defined in claim 5 wherein said piercing device is made of metal material.

13. A piercing device for piercing a hole on a body part of a person and used in conjunction with an earring post, the piercing device comprising:

a. a pair of shafts hingeably attached to each other and forming a handle portion and a jaw portion, the handle portion having an upper handle means and a lower handle means, the jaw portion having an upper jaw means and a lower jaw means;

b. a receiving plate means having a proximal section and a distal section, the proximal section attached to said lower jaw means such that the distal section extends forwardly away from said jaw portion;

c. a cup means attached to said receiving plate means;

d. a holding plate means having a distal section and a proximal section, the distal section having two gripping arms with a slit therebetween for receiving said earring post, the proximal section attached to said upper jaw means such that the two gripping arms extend forwardly away from said jaw portion;

e. a lever means hingeably attached to said upper jaw means for operating said gripping arms to clamp said earring post; and f. means for forcing said gripping arms toward each other in order to clamp said earring post;

g. whereby when said earring post is received between said gripping arms, said lever means can be moved to cause said earring post to be clamped, and said upper and lower handle means can be squeezed together to cause said earring post to pierce said hole on said body part of said person.

14. The piercing device as defined in claim 13 wherein said means for forcing said gripping arms toward each other in order to clamp said earring post includes two opposite engaging sidewalls of said lever means, each engaging sidewall having a slightly curved inward hook end for engaging with said gripping arms to force said gripping arms to move towards each other in order to clamp said earring post.

15. The piercing device as defined in claim 14 further comprising at least one stopping flange integrally attached to said holding plate means.

16. The piercing device as defined in claim 15 wherein said hook ends of said two opposite engaging sidewalls of said lever means engage said at least one stopping flange to prevent said lever means from being over tightening.

17. The piercing device as defined in claim 13 wherein said means for forcing said gripping arms towards each other in order to clam said earring post further comprises:

a. said lever means having an open proximal section and a distal section, the open proximal section having two engaging sidewalls which are positioned in spaced apart relationship, each sidewall having a hook end; and b. at least two protruding bosses with a respective one integrally formed at opposite sides of said gripping arms, each protruding boss having an inclined angle which rises from said distal section of said holding plate means to said proximal section of said holding plate means, such that when said lever means is moved forward, a respective one of said two hook ends engage with a respective one of said at least two protruding bosses respectively so that said gripping arms are forced to move toward each other to clamp said earring post.

18. The piercing device as defined in claim 17 further comprising at least one stopping flange integrally attached to said holding plate means.

19. The piercing device as defined in claim 18 wherein at least one of said hook ends of said two opposing engaging sidewalls of said lever means engage said at least one stopping flange to prevent said lever means from being overtightened.

20. The piercing device as defined in claim 13 further comprising an inner disposable protection means for protecting and covering said cup means of said receiving plate means.

21. The piercing device as defined in claim 20 further comprising an outer disposable protection means for protecting and covering said cup means and said inner disposable protection means.

22. The piercing device as defined in claim 13 further comprising a disposable protective sleeve for protecting and covering said gripping arms.

* * * * *